United States Patent [19]

Estes

[11] Patent Number: 4,911,252

[45] Date of Patent: Mar. 27, 1990

[54] ROCK BIT LOOSE CONE INDICATOR

[76] Inventor: Roy D. Estes, 7601 Will Rogers Blvd., Ft. Worth, Tex. 76140

[21] Appl. No.: 313,882

[22] Filed: Feb. 22, 1989

[51] Int. Cl.[4] ..... E21B 12/02

[52] U.S. Cl. ..... 175/39

[58] Field of Search ..... 175/39, 40; 73/151

[56] References Cited

U.S. PATENT DOCUMENTS

| | | | |
|---|---|---|---|
| 2,560,328 | 7/1951 | Bielstein | 175/39 |
| 3,058,532 | 10/1962 | Alder | 175/39 |
| 3,363,702 | 1/1968 | Bielstein | 175/39 |
| 3,678,883 | 7/1972 | Fischer | 175/39 X |
| 3,853,184 | 12/1974 | McCullough | 175/39 |
| 4,610,313 | 9/1986 | Daly et al. | 175/40 |
| 4,655,300 | 4/1987 | Davis, Jr. et al. | 175/39 |

FOREIGN PATENT DOCUMENTS

| | | | |
|---|---|---|---|
| 1051211 | 10/1983 | U.S.S.R. | 175/39 |

*Primary Examiner*—Hoang C. Dang

[57] ABSTRACT

This invention relates to a method and apparatus for detecting excessive displacement of rotating cutter cones on rotary rock bits used in earth boring. The apparatus causes a detectable pressure change in the pressurized drilling fluid system triggered by a predetermined displacement of a cone from its normal position. This is accomplished by penetration of a sensor by the displaced cone. In the simplest form the penetrated sensor forms an additional exit port for the drilling fluid thereby reducing pressure. In another embodiment the intact sensor maintains a nozzle restricting object in position within the bit body by a hydraulically actuated retainer penetration of the sensor permits loss of the hydraulic fluid and release of the restricting object which then restricts an exit port causing an immediate pressure increase.

5 Claims, 3 Drawing Sheets

ROCK BIT LOOSE CONE INDICATOR

FIELD OF THE INVENTION

This invention concerns rolling cone rock bits commonly used for drilling boreholes in the earth and particularly relates to determining when a predetermined amount of wear occurs between a rolling cone cutter and its supporting journal pin.

BACKGROUND OF THE INVENTION

Rotary rock bits are well known in the drilling art and typically comprise a bit body having three or more support arms depending therefrom and carrying journal pins which project downwardly and radially inwardly from the support arms. Cutting cones are coaxially supported on the journal pins for rotation relative thereto, and they are captively retained on the pins, by annular arrays of ball bearings disposed within facing annular races. Sealing means maintain lubricant in the bearing areas and prevent entry of borehole fluids and detritus therein. During rotation of the bit body within the earth the cutting cones are caused to rotate relative to their supporting journal pins to thereby perform the cutting function of the bit. Drilling fluid under high pressure is commonly forced through the bit remove cuttings.

A longstanding problem heretofore associated with conventional rock bits of this type is that when a bearing seal fails the inner surface of the cone and the loaded side of the journal pin begin to wear away, thereby progressively widening the gap between the top of the journal and the cone. At a certain point in time the width of such a gap can increase to an extent such that the ball bearings can escape and permit the cone to fall off its journal pin.

Cone loss must be avoided since a cone in the bottom of a drill hole can render further drilling extremely difficult, if not impossible, if the lost cone cannot be successfully fished out. The fishing-out of a separated cone is usually a laborious, time-consuming and expensive endeavor.

Heretofore, the prevention of cone loss is commonly accomplished by estimating the drilling time to which a given rock bit may be exposed, and by carefully monitoring the penetration rate, rotary torque and drill string action during this time.

The accuracy of this time estimate is unavoidably dependent upon a wide variety of factors. If this time estimate is overly conservative, unnecessary drill bit replacement costs may be incurred. On the other hand, if the time estimate is overly optimistic, and bit failure signals are not observed, cone loss can occur.

There have been several attempts to develop devices which give the driller signals that damage has occurred to the bit and it needs to be replaced, as indicated by these Pat. Nos.: 3,062,302; 3,853,184; 2,580,860; 2,647,729; 3,058,532; 3,560,328; 3,982,432; 2,925,251; 3,345,867; 3,363,702; 4,655,300; 4,785,894; 4,785,895; 4,730,681.

From the foregoing it can be seen that it would be highly desirable to provide improved rotary rock bit apparatus and associated drilling methods which eliminate or minimize above mentioned and other limitations and disadvantages typically associated with rock bits of conventional construction. Accordingly, it is an object of the present invention to provide such apparatus and methods.

SUMMARY OF THE INVENTION

This invention when embodied in a two or three cone rock bit connected to a drillstring and drilling with pressurized drilling fluid passing through it provides a method and device for detecting movement of a cone resulting from bearing degradation. An abradable sensor is connected to the center of the dome area of a bit close to the cutting elements of all cones. Any cone with enough intact cutting structure to be performing normally which loses its seal will be forced toward the sensor and will abrade through it before the cone becomes loose enough to come off its journal.

In the preferred embodiment the inside of the sensor in open communication with the pressurized drilling fluid within the bit. Penetration of this sensor provides another opening for this fluid to pass through causing a detectable reduction in the drilling fluid pressure.

In another embodiment penetration of the sensor triggers a mechanism which releases a ball within the bit which blocks one of the drilling fluid jets causing a sharp drilling fluid pressure increase.

DESCRIPTION OF THE PREFERRED EMBODIMENT

Figure 1:
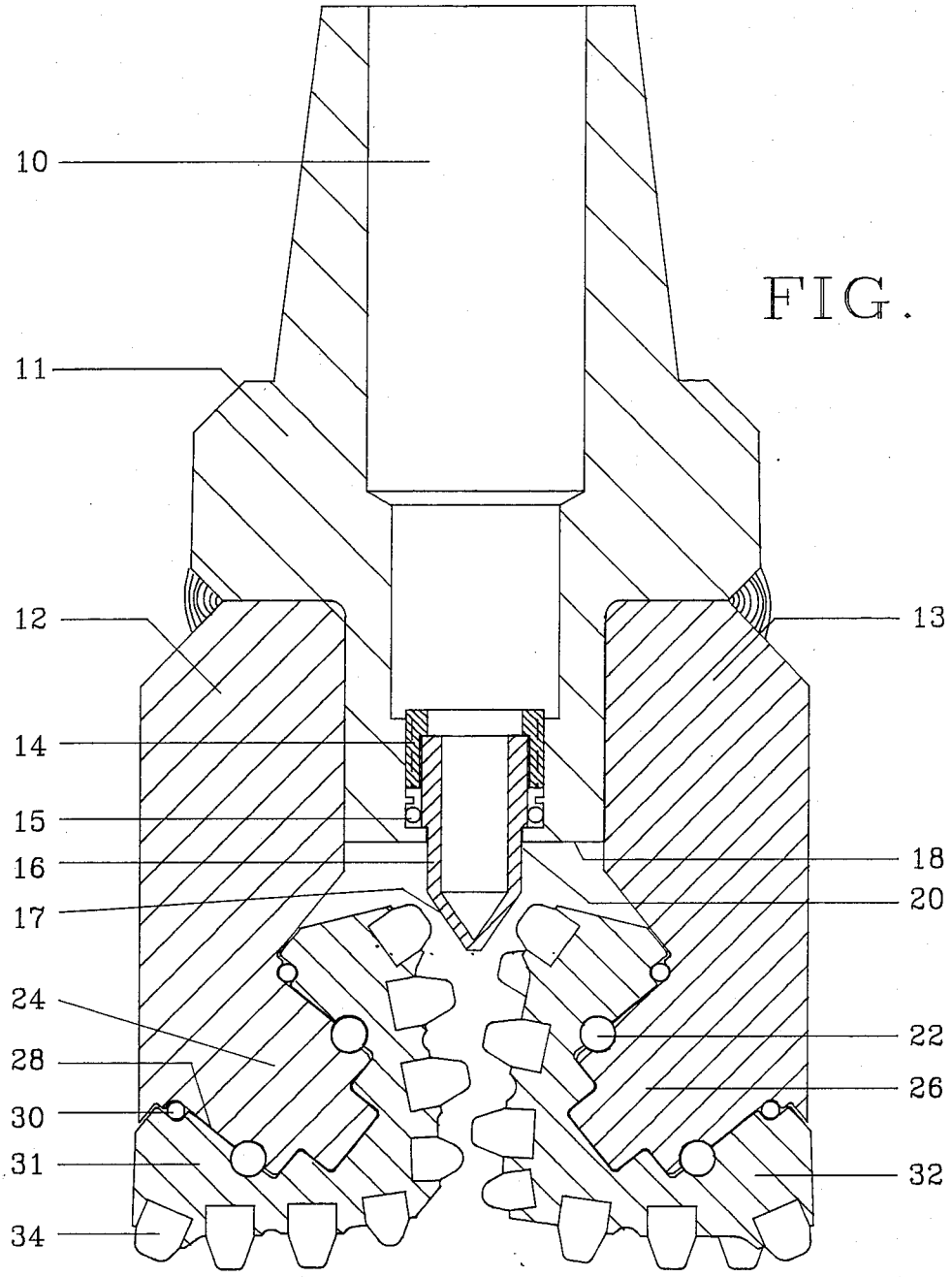
FIG. 1 illustrates a sectional view of the invention as tested in a two cone bit.

In FIG. 1 a section of a two cone sealed journal rock bit 10 is shown. The drill bit attached to a drill string (not shown) is rotated and forced downward to drill a wellbore. Pressurized drilling fluid is pumped through the drill string and is discharged through nozzled ports (not shown) in the bit to remove the detritus.

Bit 10 is composed of a body 11, two journal segments 12, and 13, and their cones 31 and 32 mounted on journal bearings 24 and 26. The cones are equipped with tungsten carbide inserts 34 which fracture the geological formation. The cones are retained on their respective journals by balls 22 in the manner common to the art. And the journal bearing area is sealed with o-ring 30 to keep detritus and drilling fluid out of the bearing area and to keep grease in that area. Along the centerline of the bit 10 is a port 20 opening through the dome 18.

The dome 18 is defined as the surface of the bit immediately above the cones. Normally this port 20 is used to hold a carbide center jet which directs drilling fluid through this area to prevent a condition of packed detritus on and above the cones known as balling.

In bit 10 a hollow sensor 16 is mounted in said port 20. Sensor 16 is a cylindrical tube of steel (or other suitable material) with one end open to the pressurized drilling fluid inside the bit and the other end closed and tapered such that when sensor 16 is installed the tapered surface 17 is in close proximity to the inserts 34 of each cone. Sensor 16 is held in place by a threaded retainer 14 and o-ring seal 15 prevents pressurized drilling fluid from escaping around said sensor.

When a seal 30 fails detritus and drilling fluid enter the bearing area and cause excessive wear to the loaded side of the journal bearing 28 and the ID of its cone 31. When such wear occurs the cone 31 is forced upward and inward by interaction of the formation and bit. When enough wear occurs inserts 34 abrade and wear through the sensor 16 and pressurized drilling fluid begans to escape. In most petroleum rotary drilling operations this drilling fluid is a liquid containing solids referred to as mud and this drilling fluid is abraisive at high pressures and velocities. (In these descriptions of various embodiments it will be assumed the drilling fluid being used is mud unless otherwise said.) Driling fluid passing through the initially abraded hole in the sensor 30 will enlarge the hole causing a detectable pump pressure drop at the surface.

A drop in drilling fluid pressure is normally associated with a condition know as a "wash out". A wash out occurs when there is a leak in the drill string. As drilling fluid passes through the leak it enlarges the hole by erosion. Eventually this results in a detectable drilling fluid pressure loss.

We field tested the device described above. The sensor was made of normalized 8620 steel and had a wall thickness about 0.08" at the taper. It was run in a 7 $\frac{7}{8}$" two cone bit with about 0.10" clearence between the inserts and sensor. The normal pump pressure was 1100 PSI. Drilling continued about two hours after a pump pressure loss was first noticed. A lag test with soft line indicated the washout was at or near the bit. During the two hours of continued drilling the pump pressure slowly went down to 600 PSI. When the sensor was retrieved it had a hole through it about the size of a nickle.

Figure 2:
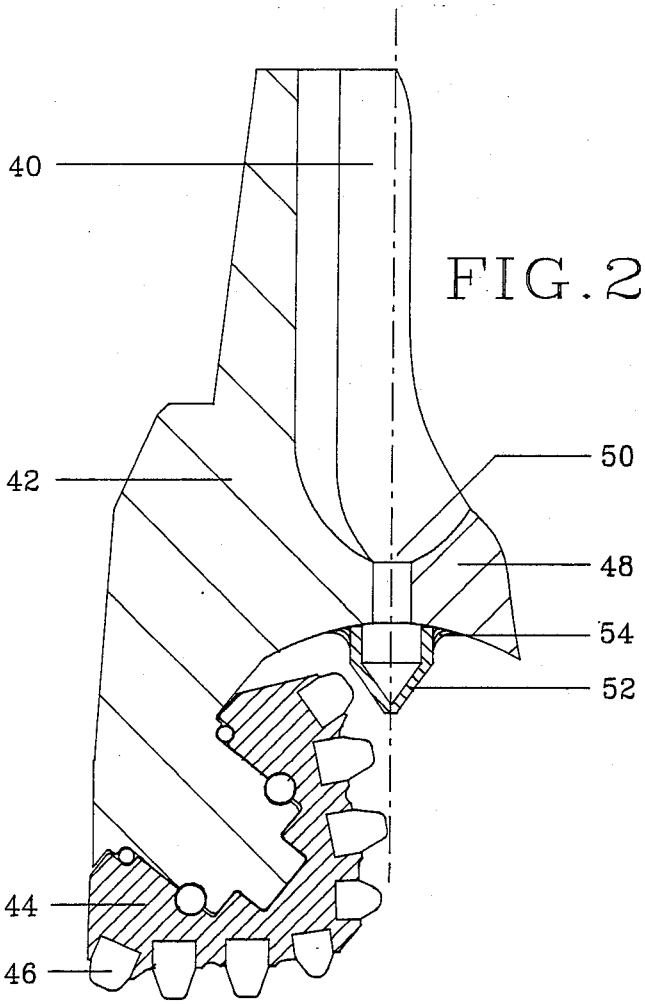
FIG. 2 illustrates a sectional view of the invention installed in a three cone bit.

In FIG. 2 a portion of a section of a bit 40 consisting of leg segment 42, cone cutter 44 with carbide inserts 46 and a small portion of another leg segment 48 is shown. A channel 50 is drilled through the central part of the bit to provide communication between the interior of the bit and the dome area. A hollow sensor 52 of suitable alloy is positioned in the dome area in close proximity to the last row of inserts of all cones and is held in position with a sealing weld 54.

This embodiment in FIG. 2 functions the same as the first embodiment and is shown to illustrate another means of installation based on the most common design of three cone rotary rock bits.

Figure 3:
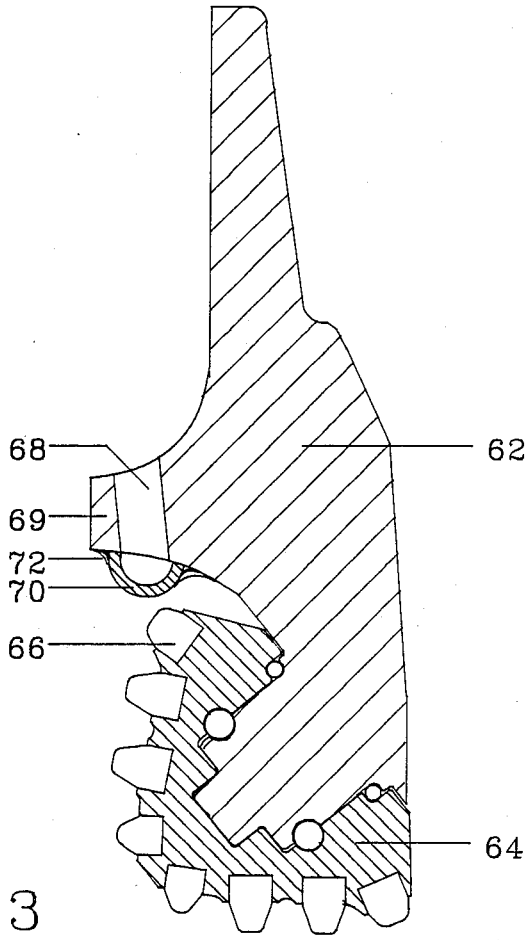
FIG. 3 illustrates a sectional view of the invention showing another method of installation.

Most rotary rock bits are built in thirds and then welded together. FIG. 3 is a section of such a bit third consisting of leg segment 62 and cone cutter 64 with carbide inserts 66. A channel 68 is formed through inner webb 69 connecting the areas that will be the interior of the bit and dome area of the completed bit. A hollow sensor 70 of suitable material and shape is positioned over channel 68 and in close proximity to inserts 66 and held in place with a sealing weld 72.

This second embodiments shows the invention built into the component parts of a bit before final assembly in cases where bit geometry would prevent installation of a single centrally located sensor onto a finished bit.

The embodiments described above use an abradable sensor material which will only function when mud is used as the drilling fluid. A frangible material can be used for the sensors which will break when forcefully contacted by a displaced cutter. Breakage of a frangible sensor would cause an immediate pressure drop even if the drilling fluid being used was air.

In the previous embodiments the existance of a loose cone could be determined at the surface by a pump pressure loss. In the following embodiment a method and device is described which will cause a high pump pressure signal to be generated when a predetermined amount of cone displacement occurs.

Figure 4:
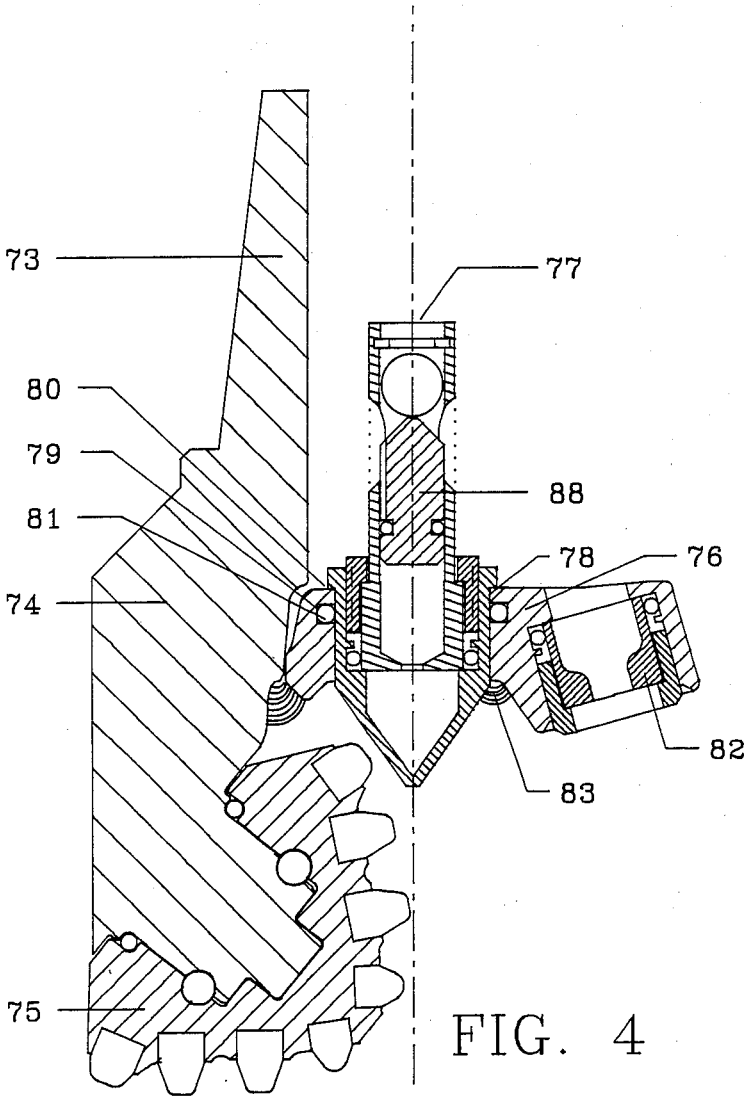
FIG. 4 illustrates a sectional view of an alternate embodiment of the invention showing a ball release mechanism.
Figure 5:
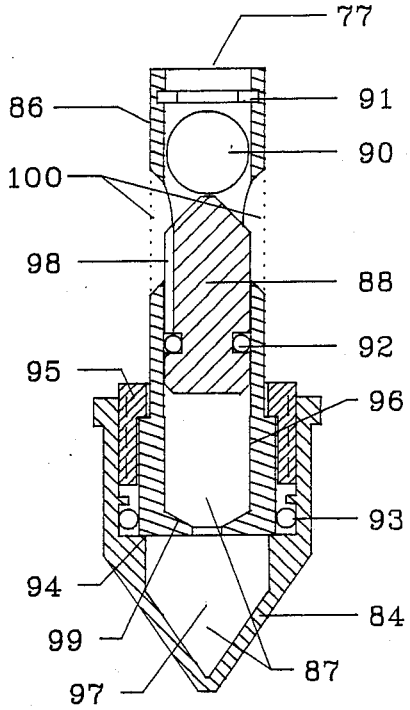
FIG. 5 illustrates a sectional view of the sensor with a ball release mechanism.

In this embodiment shown in FIG. 4 and FIG. 5 an object 90 which can restrict a discharge port 82 is mounted inside the bit above the discharge ports. The restrictive object 90 (in this case a ball) is held in place by a hydraulically locked piston 88. Penetration of the sensor shell 84 permits loss of the hydraulic fluid 97 and allows movement of the piston 88. The pressure difference between the inside and outside of the bit forces the piston out of the way of the trapped ball whenever the sensor is abraded through.

In FIG. 4 a portion of a section of a three cone rock bit 73 is shown. Bit 73 is built in accordance with the four piece forging design pecular to Rockbit Industries. Most other rock bit manufacturers use three leg segment forgings which form a complete body when welded together. We use three leg segment forgings and a nozzle holder forging to complete a bit body. Our nozzle holder forging forms the webb separating the interior of the bit from the dome area. This section of bit 73 shows a leg segment 74 with its cone 75 and a nozzle forging 76. A centrally located sensor assembly 77 is mounted in a bore 78 through the nozzle holder 76. A groove 79 to hold o-ring 81 is formed in bore 78. Assembly 77 is retained in position by a shoulder 80 resting on the interior surface of the nozzle holder 76 and tack welds 83 which bond the assembly 77 to exterior surface of said nozzle holder. A positive seal to prevent fluid flow and wash out between the assembly and nozzle holder is formed by o-ring seal 81. Nozzle 82 is one of three nozzles mounted in bit 73.

Referring now to FIG. 5, the sensor assembly 77 consists of the sensor shell 84, ball holder 86, hydraulic ball retaining piston 88, ball 90, snap ring 91, piston seal 92 and ball holder seal 93.

With the major components of this embodiment identified and illustrated in FIG. 4 and FIG. 5 we will now consider the assembly procedure. The ball holder 86 with its attendant seal 93 is positioned in the sensor shell 84 till it rests against the shoulder 94. A threaded retainer 95 screws into matching threads in the opening of the sensor shell 84 and secures the parts together. Shell 84 with holder 86 install with o-ring 81 in bore 78 and substantial tack welds 83 secure the shell 84 in position. The chamber 87 formed by the shell 84 and the bore 96 through the ball holder 86 is now filled with a suitable hydraulic liquid 97, next the piston 88 with its attendant seal 92 is positioned in bore 96. Proper installation of piston 88 requires some of the hydraulic liquid 97 to escape as the piston 88 is put in place. This is accomplished by placing a small wire (not shown) under o-ring 92 and leaving the wire sticking out through groove 98. The wire under o-ring 92 prevents it from sealing during installation and the end sticking out provides means for removal of the wire after piston 88 is installed. A ball 90 is placed above the piston and snap ring 91 is installed to trap the ball 90 in place.

The ball 90 can be designed to plug a nozzle completely and permanently or just restrict flow through the nozzle temporarily. A hard rubber ball of adequate diameter will plug a nozzle permanently, whereas a ball with deep grooves in its surface and made of a suitable material such as aluminum will only restrict the flow. And the erosive action of normal pressurized drilling mud will erode such a ball until the remains of the ball can be forced through the nozzle.

When a bearing on bit 73 fails and enough cone displacement occurs to permit the cutting structure of a cone such as cone 75 to abrade through the sensor shell 84 the drilling fluid pressure inside the bit will force the piston 88 down expelling liquid 97 out the abraded hole. The piston will be forced downward until it rests on shoulder 99 at the lower end of bore 96. The piston 88 and seal 92 then acts as a plug to prevent loss of drilling fluid through the sensor 84. When the piston has been forced downward enough to clear the side ports 100 of the ball holder 86 fluid flow and gravity will cause the ball 90 to exit one of the side ports 100 and fluid flow will carry the ball 90 to a nozzle 82 which will cause a restriction of the flow of fluid through that nozzle. Plugging a nozzle in this manner will cause an immediate and very obvious pump pressure increase signaling the driller that the bit needs to be removed and replaced.

This embodiment would work equally well on a drilling application using mud or air or water for the drilling fluid.

From the foregoing it can be seen that the present invention provides an improved rotary rock bit having incorporated therein a unique automatic signaling feature which simply and inexpensively eliminates the cone loss problems commonly associated with rock bits of conventional construction.

The foregoing detailed descriptions are to be clearly understood as given by way of illustration and example only, the spirit and scope of this invention being limited solely by the appended claims.

What is claimed is:

1. An apparatus for detecting excessive cone displacement on a rotary rock bit having at least two rotating cone cutters and at least one port through which pressurized drilling fluid consisting of liquid and solids is discharged, comprising:

an abradable hollow sensor connected to the drill bit at a selected locatin such that it is able to be abraded through by any of said rotating cone cutters which is displaced a predetermined amount; and the inside of said sensor being in open communication with said pressurized drilling fluid; and said sensor of suitable material which will continue to erode due to said drilling fluid passing through it to form essentially an additional discharge port to reduce the pressure of said pressurized drilling fluid.

2. An apparatus for detecting excessive cone displacement on a rotary rock bit having at least two rotating cone cutters and at least one port through which pressurized drilling fluid is discharged, comprising:

a frangible hollow sensor connected to the drill bit at a selected location such that it is able to be broken by any of said rotating cone cutters which is displaced a predetermined amount; and the inside of said sensor being in open communication with said pressurized drilling fluid; and said sensor of suitable material which will break when forcibly contacted by any said displaced rotating cone to form essentially an additional discharge port to reduce the pressure of said pressurized drilling fluid.

3. An apparatus for detecting excessive cone displacement on a rotary rock bit having a central bore, a dome area below the central bore, at least two leg segments extending downwardly from the dome area, a rotating cone cutter rotatably mounted to each said leg segment and positioned below the dome area and at least one port through which pressurized drilling fluid consisting of liquid and solids is discharged comprising:

hollow abradable sensors, one for each rotating cone cutter, each connected to the dome area of the drill bit at a selected location near and above its associated rotating cone cutter such that a predetermined amount of displacement of any of said cone cutters will resulted in said displaced cutter abrading through its associated sensor; the inside of each said sensor being in open communication with said pressurized drilling fluid through an unrestricted channel extending from the central bore to the dome area; and said sensors of suitable material which will continue to erode due to said drilling fluid passing through it to form essentially an additional discharge port to quickly and substantially reduce the pressure of said pressurized drilling fluid.

4. An apparatus for detecting excessive cone displacement on a rotary rock bit having a central bore, a dome area below the central bore, at least two leg segments extending downwardly from the dome area, a rotating cone cutter rotatably mounted to each said leg segment and positioned below the dome area and at least one port through which pressurized drilling fluid consisting of liquid and solids is discharged comprising:

hollow frangible sensors, one for each rotating cone cutter, each connected to the dome area of the drill bit at a selected location near and above its associated rotating cone cutter such that a predetermined displacement of any of said cone cutters will resulted in said displaced cutter breaking through its associated sensor; the inside of each said sensor being in open communication with said pressurized drilling fluid through an unrestricted channel extending from the central bore to the dome area; and said sensors of suitable material which will break when forcibly contacted by said displaced cone cutter to quickly and substantially reduce the pressure of said pressurized drilling fluid.

5. An apparatus for detecting excessive cone displacement on a rotary cone rock bit having at least two rotating cone cutters and at least two ports through which pressurized drilling fluid is discharged and having a releasable port restrictor means retained inside said bit above and clear of said ports, said restrictor means retained above and clear of said ports during normal drilling by a retaining device which contains hydraulic fluid entrapped between said retaining device and a hollow abradable sensor, said retaining device which will release said restrictor means upon loss of said hydraulic fluid said restrictor means which will be carried to a said port by drilling fluid flow upon release and which will cause an increase in drilling fluid pressure by restricting said port, comprising:

said abradable sensor connected to the drill bit at a selected location such that it is able to be abraded through by a given displacement of any said rotating cone cutters to permit loss of said hydraulic fluid.

* * * * *